US007322642B2

(12) United States Patent
BoJack

(10) Patent No.: US 7,322,642 B2
(45) Date of Patent: Jan. 29, 2008

(54) FURNITURE SYSTEM

(76) Inventor: Nancy L. BoJack, 1390 Wren, Wixom, MI (US) 48393

( * ) Notice: Subject to any disclaimer, the term of this patent is extended or adjusted under 35 U.S.C. 154(b) by 7 days.

(21) Appl. No.: 11/402,615

(22) Filed: Apr. 12, 2006

(65) Prior Publication Data

US 2007/0241590 A1 Oct. 18, 2007

(51) Int. Cl.
*A47B 39/00* (2006.01)
*A47B 83/02* (2006.01)
*A47C 7/62* (2006.01)

(52) U.S. Cl. ..... 297/135; 297/140; 297/188.08; 297/118.09; 297/188.1; 297/188.13; 297/440.1; 297/400.14

(58) Field of Classification Search ..... 297/135, 297/158.1, 158.2, 188.1, 188.08, 440.1, 440.14, 297/188.13, 188.09, 140
See application file for complete search history.

(56) References Cited

U.S. PATENT DOCUMENTS 2,268,199 A * 12/1941 Greer ..... 297/188.1 X
2,614,018 A * 10/1952 Engel ..... 297/140 X
2,808,170 A * 10/1957 Bernhard ..... 297/188.1 X
3,334,942 A * 8/1967 Breslow ..... 297/1
3,592,506 A * 7/1971 Breslow ..... 297/188.1
3,663,082 A * 5/1972 Geddes ..... 297/135 X
4,123,852 A * 11/1978 Zimowski ..... 108/49 X
4,127,948 A * 12/1978 Goy Yu Chin et al. ..... 434/416
4,205,876 A * 6/1980 Cetina ..... 297/118
4,337,988 A * 7/1982 Schenck ..... 297/140 X
4,682,827 A * 7/1987 Woodward ..... 312/231
5,938,281 A * 8/1999 Keils ..... 297/188.1 X
6,644,523 B1 * 11/2003 Salas ..... 297/188.08 X
6,929,321 B1 * 8/2005 Shrock ..... 297/188.09 X

FOREIGN PATENT DOCUMENTS

DE 3512581 A1 * 10/1986 ..... 297/188.08

* cited by examiner

*Primary Examiner*—Rodney B. White
(74) *Attorney, Agent, or Firm*—The Weintraub Group, PLC

(57) ABSTRACT

A furniture system includes a desk having an upper surface and a pair of opposed depending ground-engaging side walls, at least one of the side walls defining means for storing books or the like. An overlay overlying the desk top provides a surface for erasable writing thereon. At least one bench is stowable beneath the desk top. The bench provides a storage area and a non-tiltable seat for at least one child by providing an area in which a child's feet can be emplaced and confined. When not used as a seat, the seating member can be rotated from a horizontal to a vertical position to expose a further stowage chamber. Optimally, a second seat can be secured to the exterior of the bench.

12 Claims, 3 Drawing Sheets

FIG 1
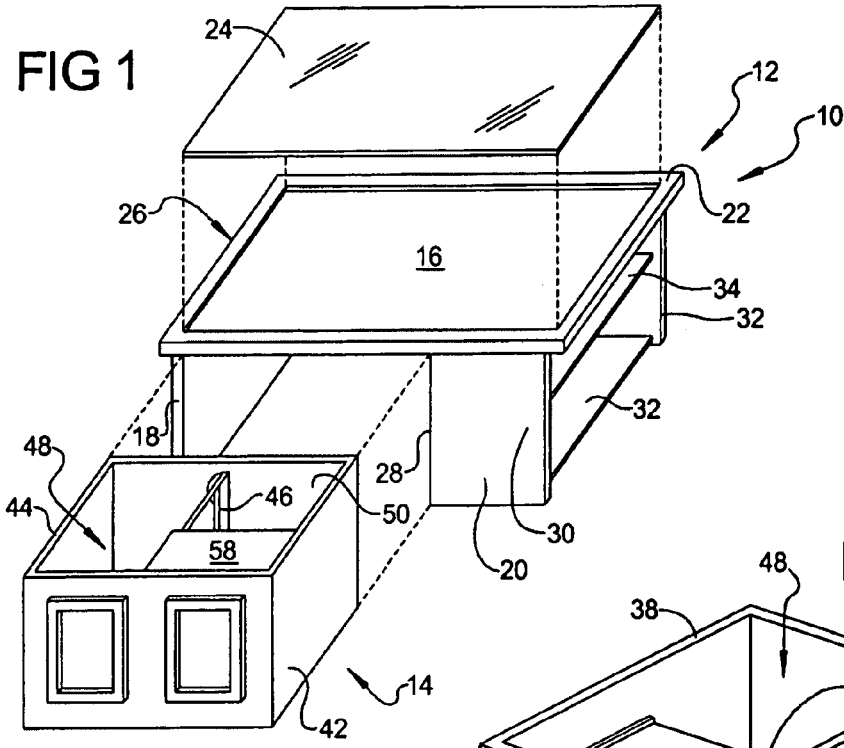
FIG 2
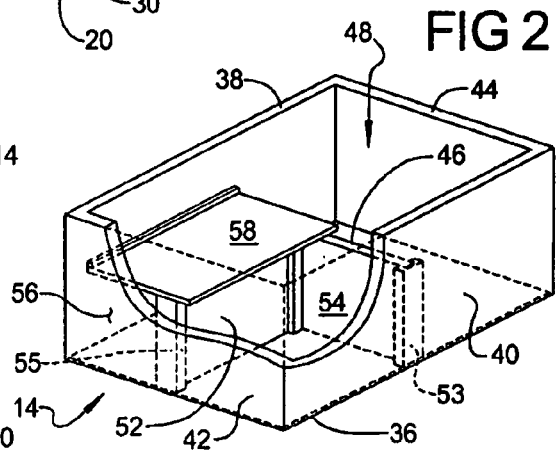
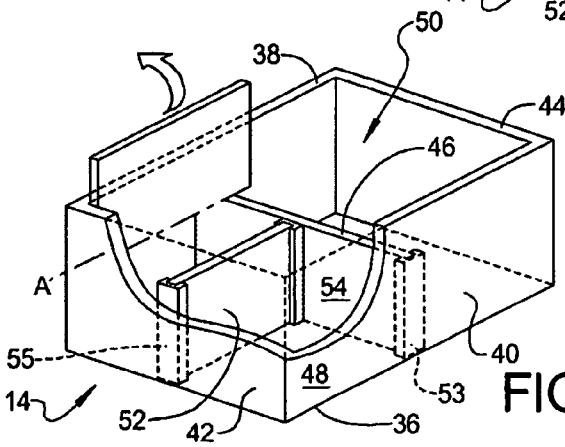
FIG 3

FIG 7
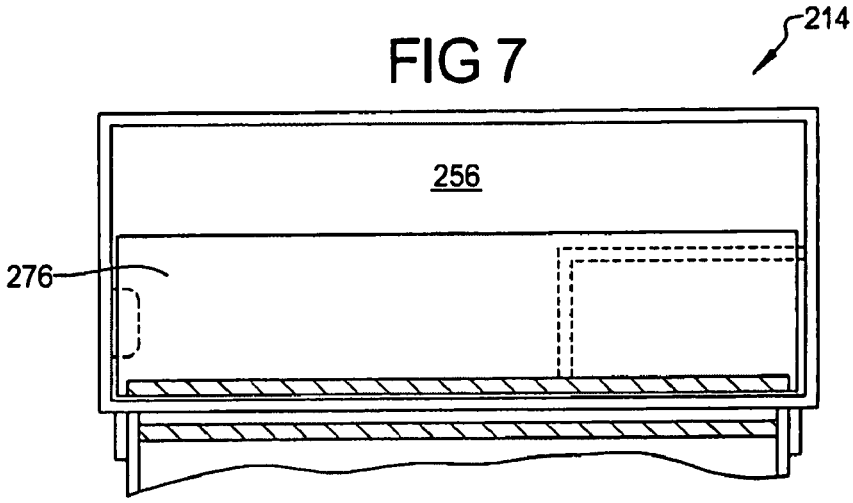
FIG 8
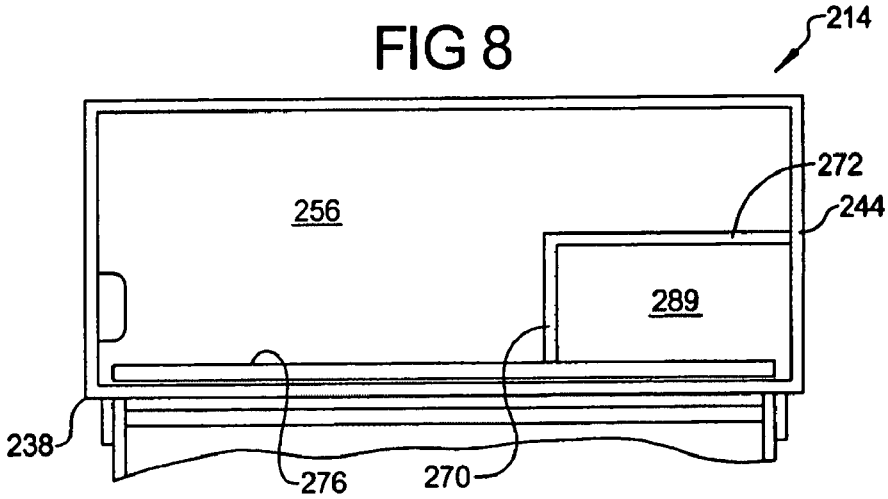
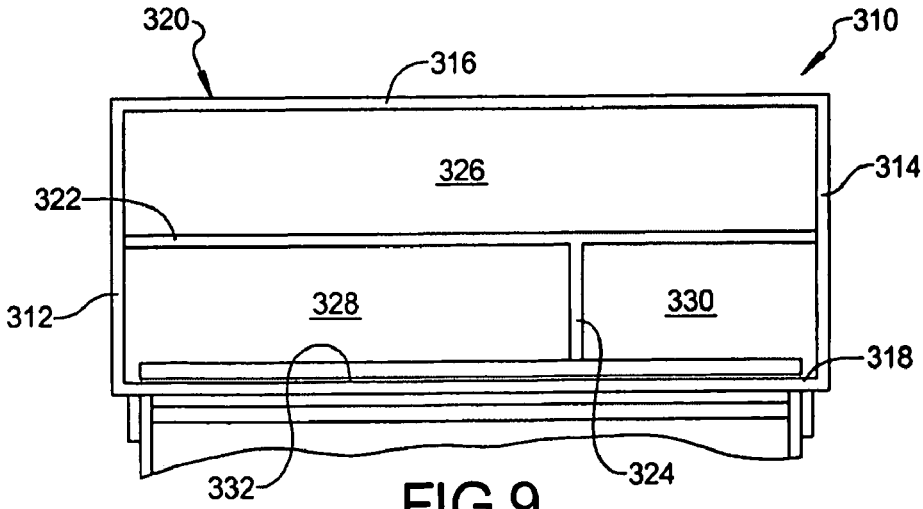
FIG 9

FURNITURE SYSTEM

BACKGROUND OF THE INVENTION

1. Field of the Invention

The present invention pertains to furniture. More particularly, the present invention pertains to furniture systems. Even more particularly, the present invention pertains to a furniture system particularly adapted for use by children and which combines stowable parts or components.

2. Prior Art

As is known to those skilled in the art to which the present invention pertains, furniture systems particularly those specifically adapted for use by children are ordinarily restricted to sleeping systems, such as bunk beds and the like, as well as small tables, desks and chairs where children play games, draw, etc. Yet, with respect to the latter type of furniture, children, being rambunctious, when sitting in a chair, have a tendency to tilt or rock the chair. This easily precipitates the child hurting himself or herself when the chair falls over. Similarly, within the context of a home, children collect toys, books and other paraphernalia and the stowability of same becomes an issue.

As is detailed herein the present invention provides, not only a safety bench, to prevent a child from falling backwards but, which at the same time, provides a table top or desk surface for entertainment and games as well as providing stowability.

SUMMARY OF THE INVENTION

In accordance with the present invention there is provided a furniture system which, generally, comprises:

(a) a desk having an upper surface and a pair of opposed depending ground-engaging side walls, at least one of the side walls defining means for storing books or the like;

(b) an overlay overlying the desk top and providing a surface for erasable writing thereon, and (c) at least one bench stowable beneath the desk top, the stowable bench including a non-tiltable seat.

With more particularity, the bench has at least one divider for dividing the bench into a stowage compartment and a seating compartment, the seating compartment including a chamber in which a child's feet may be emplaced and a seating surface such that the child sits on the seating surface with his or her feet disposed within the chamber to prevent the tilting and rocking of the bench.

In an alternate embodiment, the seating surface is configured to accommodate more than one child When not used as a seat, the seating member can be rotated from a horizontal to a vertical position to expose a further stowage chamber.

For a more complete understanding of the present invention reference is made to the following detailed description and accompanying drawings. In the drawings like reference characters refer to like parts throughout the several views which:

BRIEF DESCRIPTION OF THE DRAWINGS

FIG. 1 is a perspective view of the furniture system hereof;

FIG. 2 is a perspective view of a stowable bench in accordance herewith;

FIG. 3 is a second perspective view of the bench hereof, and

FIG. 7 is a top plan view of a third embodiment hereof showing the seat in a first position;

FIG. 8 is a top plan view of the embodiment of FIG. 7 but showing the seat in an upright position;

FIG. 9 is a top plane view of a third embodiment hereof.

DETAILED DESCRIPTION OF THE PREFERRED EMBODIMENT

Figure 4:
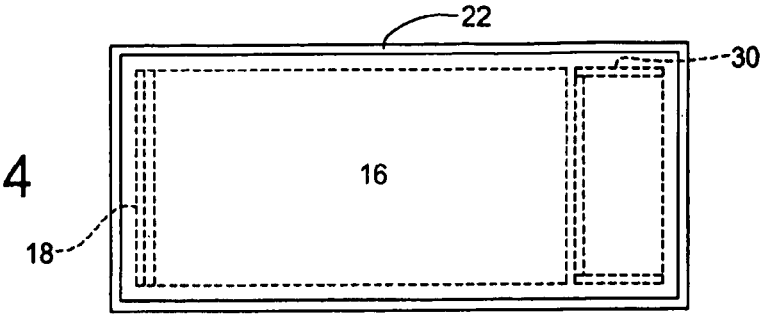
FIG. 4 is a top plan view, partly in phantom, of the furniture system hereof.

With more particularity, and as shown in the drawing, and, in particular FIGS. 1-4, there is provided a furniture system 10 which, generally comprises a table or desk 12 having at least one bench 14, associated therewith, the bench 14, being stowable beneath the tabletop or desktop.

As shown, the desk or table 12, includes a top or top surface or upper surface 16 and depending opposed legs or sidewalls 18 and 20, respectively. The top or top surface 16 is bordered by a perimetral edge or molding 22 which extends above the top surface 16. A removable transparent or translucent overlay 24 seats atop the top surface 16 and thus, a gap 26 is provided between the top 16 and the overlay 24. The gap 26 enable items such as a checkerboard, photographs, and other types of items (not shown) to be disposed and displayed between the top surface 16 and the overlay 24.

As shown, the overlay 24 nests within the area defined by the perimetral edge and over the top surface 16. It should be noted that the overlay 24 can be removably mounted on the top surface 16 by any means such as by magnets, by merely sitting atop thereof or in any other manner to enable it to be removably seated or disposed there atop.

The overlay 24 is, preferably, formed from an erasable surface, such as an acrylic sheet or glass upon which can be used crayons, dry erasable markers and the like to enable a child to draw thereon. Thus, the overlay provides an erasable marking surface. It should be noted that the overlay is optional, but, preferable.

Referring again to the drawing, and as noted above, downwardly depending from the top surface 16 at opposed ends thereof are ground-engaging sidewalls or legs, 18 and 20, respectively. At least one sidewall, here shown as leg 20 comprises an inset back wall 28, spaced apart side walls 30, 32 and a plurality of vertically axially spaced apart ledges 34. The space between the ledges 34 being sufficient to enable the ledges to define bookshelves for stowage of reading materials and the like.

Referring now to FIGS. 2-4 there is shown therein the bench or seat 14 for use herein. The bench 14 is dimensioned to stow beneath the top 16 of the table 12. The bench 14 comprises an open-topped member having a base 36 upstanding side walls 38, 40 and end walls 42 and 44. At least one of the chambers or both can be used to store toys, games, etc. A second removable divider 52, disposed normal to the first divider 46 bisects the chamber 50 into two sub-chambers 54 and 56.

A divider 46 extends between the sidewalls 38, 40 of the bench to divide the interior of the bench into two interior chambers 48 and 50.

A rotatable seat 58 is hingedly mounted within the interior of the bench and rotates between a closed position and an open position. The seat is dimensioned to seat atop the divider walls 46 and 52, and is stabilized by seating atop a brace (not shown) secured to the end wall 42.

Preferably, the dividers 46 and 52 can be rendered removable by emplacing them in guideways, such as guideways 53 and 55.

The seat 58 does not traverse the entire width of the bench but, rather, only extends partially across the span between the sidewalls. Thus, the chamber 54 is always open enabling a child to sit atop the seat 58 with his or her legs disposed in the chamber 54. Because of the dimensioning of the bench the child cannot, without great effort, rock the bench and tilt it backwards or forwards. Thus, the ability to fall backward or forward is greatly minimized.

It is apparent when not in use by a child, the chambers 54 and 56 also define a storage compartment for toys or the like.

Further, by removing both of the dividers 46 and 52, when used, an open storage chamber is provided by retaining the seat 58 in an upward position by any suitable means, such as a hook or the like (not shown).

In practicing the present invention it is contemplated that there be a pair of benches each slidingly stowable underneath the top 16

It is apparent that the present invention need not be limited to use by children. Rather, the overlay 24 can be used in cooperation with the top 16 to encase and display photographs, sewing patterns, memorabilia etc.

It is further contemplated, although not shown, that each of the legs 18 and 20 comprise a bookcase.

Figure 5:
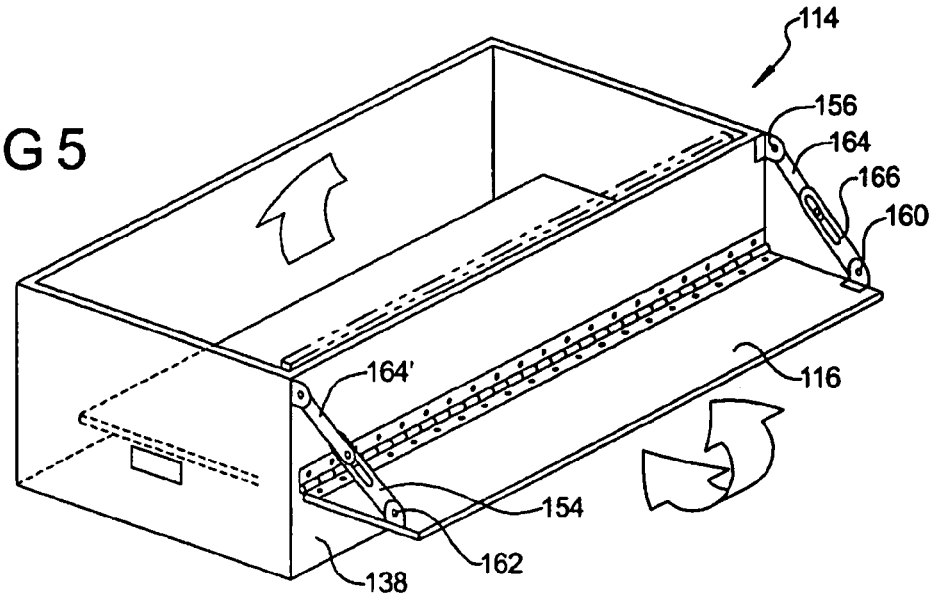
FIG. 5 is a perspective view of an alternate embodiment hereof.
Figure 6A:
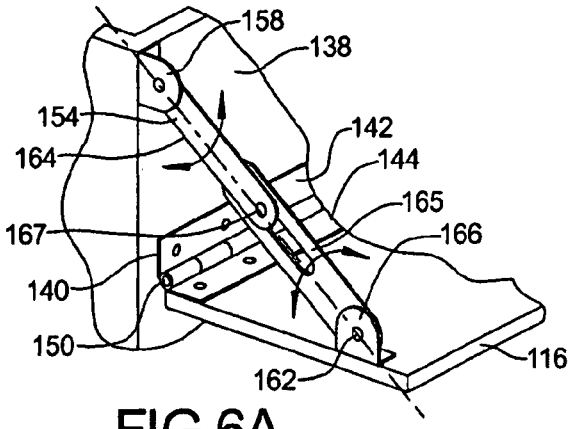
FIG. 6*a* is a partial, perspective view of a portion of the embodiment of FIG. 5 showing the bench and hinge in a first position.
Figure 6B:
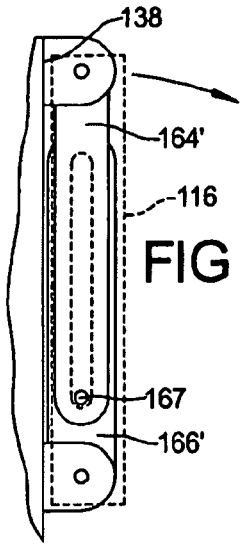
FIG. 6*b* is a side-elevational view of the embodiment of FIG. 5 hereof with the bench in a second upright position.

Referring now to FIGS. 5, 6*a* and 6*b* there shown therein a further embodiment of the bench, of the present invention denoted at 114.

According to this embodiment, a seat 116 is rotatably secured to the exterior side wall 138. A hinge 140 is secured to the exterior of the side wall 138 by any suitable means such as screws, nails or other means for fastening. The hinge 140 comprises a first plate 142, which is secured to the wall 138 and a second plate 144 secured to the seat 116 which interdigitates with the first plate 142 in a well known manner. A pin 150 extends along the length of the plates to retain the interdigitation. The second plate 144 is rotatable between a first horizontal position as shown in FIGS. 5 and 6*a* and a second vertical position in abutment with the side wall 138, as shown in FIG. 6*b*. A pair of opposed, spaced-apart support brackets 152, 154 respectively, each have a first end 156 and 158, respectively, secured to the side wall 138 and a second end 160, 162, respectively, secured to the seat 116.

The support bracket is of conventional configuration and each includes first and second elements 164, 164' and 166, 166' respectively. Each element or member 166 or 166' is slotted at 165 to enable a locking pin 167 affixed to the terminus of the member 164' to project into the seat and be retained therewithin. The pin 167 limits the amount of rotation of the seat 116 and, necessarily, the plate 144.

The pin 167, also, provides a guide for each second element 166, 166' to render the seat stowable, as shown in FIG. 6*b*, in the well-known manner.

Clearly, other types of lockable support brackets, such as a pin and spring-loaded detent assembly, a cammed lock or the like may be used.

Referring now to FIGS. 7 and 8 there is shown therein a further embodiment thereof. In this embodiment the chamber 256 is divided by interior walls 270 and 272, the wall 272 being normal to the wall 270 and cooperating with the end wall 244 and the side wall 238 to form a small enclosure 239 within the chamber 256. Here, the seat 276 traverses the entire length of the bench 214, the first end thereof being supported by the walls which define the enclosure 239 and an opposed support member 278 disposed within the interior.

As shown in FIG. 8 the seat 276 is rotatable to an upright position to, thus, provide two interior chambers, as shown.

Referring now to FIG. 9 there is shown a further embodiment of the bench contemplated for use herein and generally denoted at 310. As with the first two embodiments the bench 310 comprises opposed end walls 312 and 314 and side walls 316 and 318 integral therewith to form an open topped container. The walls 312, 314, 316, 318 extend upwardly from a base 320. According to this embodiment a divider 322 traverses the length of the bench 310 and a medial divider 324 divides the interior of the bench into three chambers 326, 328 and 330, respectively. Again, as with the seat of the embodiment of FIGS. 7 and 8, the seat 332 traverses the entire length of the bench 310. However, it should be noted that such construction is not limited thereto. Rather, the seat may only traverse a portion of the length of the bench.

The seat 332 is rotatable between first and second positions i.e., between a horizontal and a vertical position in the manner previously described. Furthermore, the exterior seat 166 of the second embodiment is optional in this embodiment.

From the above it is readily appreciated that there has been defined herein a furniture system which enables storage, such as for toys, entertainment and safety. The furniture system also enables the display of various items, as well.

Having, thus, described the invention what is claimed is:

1. A furniture system comprising:

(a) a desk having an upper surface and a pair of opposed depending downwardly extending ground-engaging side walls, at least one of the side walls defining means for storing books;

(b) an overlay overlying the desk top and providing a surface for erasable writing thereon, and (c) at least one bench stowable beneath the desk top, the stowable bench having at least one interior chamber formed therewithin, and (d) a non-tiltable seat, disposed within the chamber.

2. The furniture system of claim 1 wherein the overlay is a transparent acrylic member.

3. The furniture system of claim 1 wherein the overlay is formed from glass.

4. The furniture system of claim 1 which further comprises:

a perimetral molding, the molding surrounding the top surface of the desk to enable the overlay to be positioned therewithin and atop the top surface.

5. The furniture system of claim 1 wherein the stowable bench comprises:

(a) an open-topped member having a base and a pair of opposed upwardly extending end walls and a pair of upwardly extending opposed side walls, the walls and the base cooperating to define an integrally formed open-topped member having the interior chamber, and (b) a first divider traversing the interior of the bench and extending between the sidewalls to divide the interior into two sub-chambers.

6. The furniture system of claim 5 wherein the bench further comprises a second divider to divide the interior of the bench into three chambers.

7. The bench of claim 5 which further comprises:

a divider wall extending between one of the pair of end walls and the first divider to divide one of the sub-chambers into two further chambers.

8. The furniture system of claim 7 wherein the bench further comprises:

a first seating member, the seating member being rotatable between a first upward position and a second horizontal position, the seating member defining a first seat, the first seat projecting from a side wall into the interior of the bench and being substantially perpendicular to the first divider and the second divider such that one of the sub-chambers is accessible for a child's feet to seat therewithin.

9. The furniture system of claim 8 wherein the first seating member traverses the length of the bench.

10. The furniture system of claim 9 which further comprises a second seat secured to the exterior of the bench, the second seat being rotatable between a first vertical stowed position and a horizontal seating position.

11. The furniture system of claim 1 wherein at least one of the downwardly depending desk sidewalls comprises:

a back wall, a pair of spaced-apart side walls, a plurality of vertically axially spaced ledges extending between the side walls, and wherein the ledges define a plurality of book shelves.

12. The furniture system of claim 1 which further comprises:

a pair of benches, each of the benches being stowable beneath the desk top and between the desk side walls.

* * * * *